US008464866B2

(12) United States Patent
Sutherland et al.

(10) Patent No.: US 8,464,866 B2
(45) **Date of Patent: *Jun. 18, 2013**

(54) PACKAGE FOR CONTAINER

(75) Inventors: Robert L. Sutherland, Kennesaw, GA (US); Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 77 days.

This patent is subject to a terminal disclaimer.

(21) Appl. No.: 12/603,727

(22) Filed: Oct. 22, 2009

(65) Prior Publication Data

US 2010/0078337 A1 Apr. 1, 2010

Related U.S. Application Data

(63) Continuation-in-part of application No. 12/253,485, filed on Oct. 17, 2008, now Pat. No. 7,823,721.

(60) Provisional application No. 61/107,359, filed on Oct. 22, 2008, provisional application No. 60/981,025, filed on Oct. 18, 2007.

(51) Int. Cl.
*B65D 75/00* (2006.01)

(52) U.S. Cl.
USPC ..... 206/153; 206/161; 206/158; 206/434

(58) Field of Classification Search
USPC ..... 206/149, 151, 155, 158, 194, 197, 206/199, 429, 153, 161, 162, 200, 434, 426; 294/87.2
See application file for complete search history.

(56) References Cited

U.S. PATENT DOCUMENTS

| | | | | |
|---|---|---|---|---|
| 1,527,399 | A | | 2/1925 | Davidson |
| 2,111,621 | A | | 3/1938 | Gerking |
| 2,289,859 | A | | 7/1942 | Arthur |
| 2,522,950 | A | | 9/1950 | Keith |
| 2,575,654 | A | | 11/1951 | Casler |
| 2,798,603 | A | * | 7/1957 | Grinspoon ..... 206/153 |
| 2,950,041 | A | | 8/1960 | Stone |
| 3,073,440 | A | | 1/1963 | Jones |
| 3,528,697 | A | | 9/1970 | Wood |
| 3,897,873 | A | | 8/1975 | Graser |
| 3,942,631 | A | | 3/1976 | Sutherland et al. |
| 4,029,204 | A | | 6/1977 | Manizza |

(Continued)

FOREIGN PATENT DOCUMENTS

| | | |
|---|---|---|
| EP | 0 240 126 A2 | 10/1987 |
| EP | 0 240 126 A3 | 10/1987 |

(Continued)

OTHER PUBLICATIONS

International Search Report and Written Opinion from PCT/US2009/061594, Feb. 5, 2010.

(Continued)

*Primary Examiner* — David T. Fidei
(74) *Attorney, Agent, or Firm* — Womble Carlyle Sandridge & Rice, LLP

(57) ABSTRACT

A package for holding a plurality of containers. The package has a top panel and side panels. The package has retention features for retaining the containers and reinforcement features for reinforcing the package.

19 Claims, 17 Drawing Sheets

U.S. PATENT DOCUMENTS

| | | | | | |
|---|---|---|---|---|---|
| 4,096,985 | A | | 6/1978 | Wood | |
| 4,190,149 | A | | 2/1980 | Oliff et al. | |
| 4,304,329 | A | | 12/1981 | Graser | |
| 4,372,599 | A | | 2/1983 | Kiedaisch et al. | |
| 4,378,878 | A | | 4/1983 | Graser | |
| 4,378,879 | A | | 4/1983 | Killy | |
| 4,382,505 | A | | 5/1983 | Sutherland et al. | |
| 4,386,699 | A | | 6/1983 | Sutherland | |
| 4,403,689 | A | | 9/1983 | Wood | |
| 4,465,180 | A | | 8/1984 | Klygis | |
| 4,646,917 | A | | 3/1987 | Schuster | |
| 4,681,217 | A | | 7/1987 | Hernandez | |
| 4,736,977 | A | * | 4/1988 | Killy | 294/87.2 |
| 4,784,266 | A | | 11/1988 | Chaussadas | |
| 4,941,624 | A | | 7/1990 | Schuster | |
| 5,139,147 | A | * | 8/1992 | Sutherland | 206/431 |
| 5,163,548 | A | | 11/1992 | Domansky | |
| 5,188,225 | A | | 2/1993 | Jorba et al. | |
| 5,201,412 | A | | 4/1993 | Schuster et al. | |
| 5,267,644 | A | | 12/1993 | Tsao | |
| 5,273,156 | A | | 12/1993 | Harris | |
| 5,297,673 | A | | 3/1994 | Sutherland | |
| 5,310,050 | A | | 5/1994 | Sutherland | |
| 5,310,051 | A | | 5/1994 | Sutherland | |
| 5,311,994 | A | * | 5/1994 | Oliff | 206/427 |
| 5,314,224 | A | * | 5/1994 | Bates | 294/87.2 |
| 5,323,895 | A | | 6/1994 | Sutherland et al. | |
| 5,328,024 | A | | 7/1994 | Sutherland | |
| 5,344,006 | A | | 9/1994 | Mazzeo | |
| 5,351,815 | A | | 10/1994 | Fogle et al. | |
| 5,351,816 | A | | 10/1994 | Sutherland et al. | |
| 5,351,817 | A | | 10/1994 | Sutherland | |
| 5,355,999 | A | | 10/1994 | Sutherland | |
| 5,360,104 | A | | 11/1994 | Sutherland | |
| 5,390,784 | A | | 2/1995 | Sutherland | |
| 5,407,065 | A | | 4/1995 | Sutherland | |
| 5,415,278 | A | | 5/1995 | Sutherland | |
| 5,443,153 | A | | 8/1995 | Sutherland | |
| 5,445,262 | A | * | 8/1995 | Sutherland | 206/148 |
| 5,452,799 | A | | 9/1995 | Sutherland | |
| 5,474,172 | A | | 12/1995 | Zavatone et al. | |
| 5,501,335 | A | | 3/1996 | Harris | |
| 5,503,267 | A | | 4/1996 | Sutherland | |
| 5,520,283 | A | | 5/1996 | Sutherland | |
| 5,524,756 | A | | 6/1996 | Sutherland | |
| 5,551,566 | A | | 9/1996 | Sutherland | |
| 5,553,705 | A | * | 9/1996 | Bakx | 206/158 |
| 5,582,289 | A | | 12/1996 | Wright | |
| 5,590,776 | A | | 1/1997 | Galbierz | |
| 5,593,027 | A | | 1/1997 | Sutherland | |
| 5,639,017 | A | | 6/1997 | Fogle | |
| 5,735,394 | A | | 4/1998 | Harrelson | |
| 5,746,310 | A | | 5/1998 | Slomski | |
| 5,791,463 | A | | 8/1998 | Negelen | |
| 5,794,778 | A | | 8/1998 | Harris | |
| 5,816,391 | A | | 10/1998 | Harris | |
| 5,871,090 | A | | 2/1999 | Doucette et al. | |
| 5,873,515 | A | | 2/1999 | Dunn et al. | |
| 5,915,546 | A | | 6/1999 | Harrelson | |
| 5,921,392 | A | * | 7/1999 | Davis | 206/434 |
| 5,960,945 | A | * | 10/1999 | Sutherland | 206/158 |
| 5,979,747 | A | | 11/1999 | Gnadt et al. | |
| 5,992,733 | A | | 11/1999 | Gomes | |
| 6,039,181 | A | * | 3/2000 | Whiteside | 206/428 |
| 6,059,099 | A | | 5/2000 | Galbierz | |
| 6,065,590 | A | | 5/2000 | Spivey | |
| 6,315,111 | B1 | | 11/2001 | Sutherland | |
| 6,484,903 | B2 | | 11/2002 | Spivey et al. | |
| 6,896,130 | B2 | | 5/2005 | Theelen | |
| 6,926,193 | B2 | | 8/2005 | Smalley | |
| 7,011,209 | B2 | | 3/2006 | Sutherland et al. | |
| 7,793,779 | B2 | * | 9/2010 | Spivey et al. | 206/153 |
| 7,823,721 | B2 | * | 11/2010 | Sutherland et al. | 206/153 |
| 8,100,256 | B2 | * | 1/2012 | Spivey et al. | 206/153 |
| 2002/0195371 | A1 | | 12/2002 | Brown | |
| 2003/0080004 | A1 | | 5/2003 | Olsen et al. | |
| 2003/0111362 | A1 | | 6/2003 | Sutherland et al. | |
| 2003/0213705 | A1 | | 11/2003 | Woog | |
| 2005/0127151 | A1 | | 6/2005 | Johnson | |
| 2007/0029371 | A1 | | 2/2007 | Theelen | |
| 2007/0164091 | A1 | | 7/2007 | Fogle et al. | |
| 2007/0181658 | A1 | | 8/2007 | Sutherland | |
| 2009/0101526 | A1 | | 4/2009 | Sutherland | |
| 2009/0127147 | A1 | | 5/2009 | Sutherland | |
| 2009/0250357 | A1 | | 10/2009 | Spivey, Sr. | |
| 2010/0078337 | A1 | | 4/2010 | Sutherland et al. | |
| 2010/0264043 | A1 | | 10/2010 | De Paula | |
| 2011/0000799 | A1 | | 1/2011 | Gonzalez et al. | |

FOREIGN PATENT DOCUMENTS

| | | | |
|---|---|---|---|
| EP | 0 425 135 | A2 | 5/1991 |
| EP | 0 428 354 | A1 | 5/1991 |
| GB | 2 238 285 | A | 5/1991 |
| GB | 2321229 | A | 7/1998 |
| JP | 03-148459 | | 6/1991 |
| JP | 03-176374 | | 7/1991 |
| JP | 08-509944 | | 10/1996 |
| JP | 2003-146359 | | 5/2003 |
| JP | 2003300554 | A | 10/2003 |
| WO | 9422738 | A1 | 10/1994 |
| WO | 9501289 | A1 | 1/1995 |
| WO | 9523745 | | 9/1995 |
| WO | WO 95/23745 | | 9/1995 |

OTHER PUBLICATIONS

International Search Report and Written Opinion—PCT/US2008/080279, mailed Dec. 18, 2008 (Graphic Packaging International, Inc. applicant).

International Search Report and Written Opinion—PCT/US2009/061594, mailed Feb. 4, 2010 (Graphic Packaging International, Inc. applicant).

Restriction Requirement mailed Oct. 30, 2009 for related (parent) U.S. Appl. No. 12/253,485.

Response to Restriction Requirement mailed Nov. 23, 2009 for related (parent) U.S. Appl. No. 12/253,485.

Office Action mailed Mar. 24, 2010 for related (parent) U.S. Appl. No. 12/253,485.

Response to Office Action mailed Jun. 24, 2010 for related (parent) U.S. Appl. No. 12/253,485.

Notice of Allowance mailed Jul. 12, 2010 for related (parent) U.S. Appl. No. 12/253,485.

312 Amendment mailed Sep. 9, 2010 for related (parent) U.S. Appl. No. 12/253,485.

Notification of Reason for Refusal dated Jun. 4, 2012 for JP Application No. 2010-534199 and English translation.

International Search Report and Written Opinion dated Aug. 18, 2011 for PCT/2010/060973.

Office Action for Canadian Application No. 2,705,561, dated Sep. 15, 2011.

Office Action for Canadian Application No. 2,699,990, dated Aug. 16, 2011.

Office Action for Canadian Application No. 2,705,561 dated Mar. 1, 2012.

Supplementary European Search Report for EP 09 82 2676 dated Mar. 5, 2012.

* cited by examiner

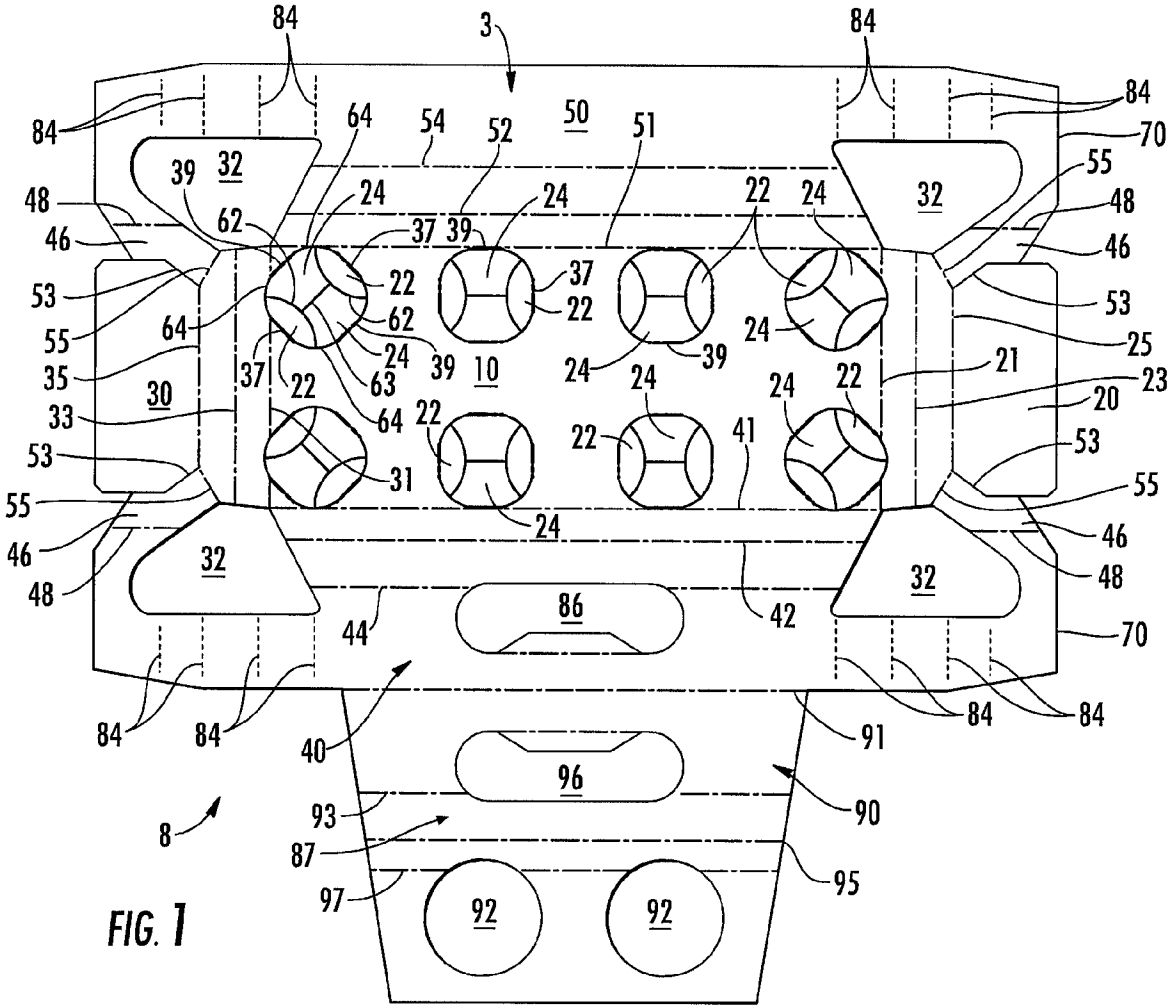
FIG. 1
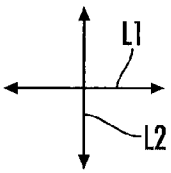

PACKAGE FOR CONTAINER

CROSS-REFERENCE TO RELATED APPLICATIONS

This application claims the benefit of U.S. Provisional Application No. 61/107,359, which was filed on Oct. 22, 2008. This application is a continuation-in-part of U.S. patent application Ser. No. 12/253,485, which was filed on Oct. 17, 2008 and claims the benefit of U.S. Provisional Application No. 60/981,025, which was filed on Oct. 18, 2007.

Incorporation by Reference

U.S. Provisional Application No. 61/107,359, which was filed on Oct. 22, 2008, U.S. patent application Ser. No. 12/253,485, which was filed on Oct. 17, 2008, and U.S. Provisional Application No. 60/981,025, which was filed on Oct. 18, 2007, are hereby incorporated by reference for all purposes as if presented herein in their entirety.

BACKGROUND OF THE DISCLOSURE

The present disclosure generally relates to packages or cartons for holding and carrying containers.

SUMMARY OF THE DISCLOSURE

In general, one aspect of the disclosure is generally directed to a package for holding a plurality of containers. The package has a top panel and a side panel. The package has reinforcement features for reinforcing the top panel.

In another aspect, the disclosure is generally directed to a blank for forming a package for holding a plurality of containers. The blank comprises a top panel, a side panel, and a reinforcement flap foldably connected to the side panel. The reinforcement flap being for at least partially overlapping the top panel when the blank is formed into the carton.

In another aspect, the disclosure is generally directed to a package for containing a plurality of articles, the package comprising panels that extend at least partially around an interior of the package. The panels comprise a top panel and a side panel foldably connected to the top panel. At least one opening in the top panel is for at least partially receiving at least a portion of one of the articles. A reinforcement flap is foldably connected to the side panel and positioned relative to the side panel for reinforcing the side panel. A handle is in the side panel and the reinforcement flap. The handle is adapted for use in grasping and carrying the carton.

In another aspect, the disclosure is generally directed to a blank for forming a package for containing a plurality of articles. The blank comprises panels that comprise a top panel and a side panel foldably connected to the top panel. At least one opening is in the top panel. A reinforcement flap is foldably connected to the side panel for positioning relative to the side panel and reinforcing the side panel. Handle features are in the side panel and the reinforcement flap. The handle features are for use in grasping and carrying the package formed from the blank.

In another aspect, the disclosure is generally directed to a method of forming a package. The method comprising providing a blank comprising a top panel, a side panel foldably connected to the top panel, a plurality of openings in the top panel, a reinforcement flap foldably connected to the side panel for positioning relative to the side panel and reinforcing the side panel, and handle features in the side panel and the reinforcement flap. The method further comprising positioning a plurality of articles relative to the blank and positioning the blank relative to the articles so that the plurality of articles are at least partially received in respective openings of the plurality of openings. The method further comprising folding the reinforcement flap to be in face-to-face contact with the side panel and downwardly folding the side panel relative to the top panel to at least partially enclose the articles in an interior space of the package.

In another aspect, the disclosure is generally directed to a package for holding a plurality of articles. The package comprises panels that extend at least partially around an interior of the package. The panels comprise a top panel and a side panel foldably connected to the top panel. At least one opening is in the top panel for at least partially receiving at least a portion of one of the articles. A reinforcement flap is foldably connected to the side panel and positioned relative to the side panel for reinforcing the side panel.

In another aspect, the disclosure is generally directed to a blank for forming a package for holding a plurality of articles. The blank comprises panels that comprise a top panel and a side panel foldably connected to the top panel. At least one opening is in the top panel. A reinforcement flap is foldably connected to the side panel for positioning relative to the side panel and reinforcing the side panel.

In another aspect, the disclosure is generally directed to a method of forming a package. The method comprises obtaining a blank comprising a top panel, a side panel foldably connected to the top panel, a plurality of openings in the top panel, and a reinforcement flap foldably connected to the side panel for positioning relative to the side panel and reinforcing the side panel. The method comprises positioning a plurality of articles relative to the blank, positioning the blank relative to the articles so that the plurality of articles are at least partially received in respective openings of the plurality of openings, folding the reinforcement flap to be in face-to-face contact with the side panel, and downwardly folding the side panel relative to the top panel to at least partially enclose the articles in an interior space of the package.

In another aspect, the disclosure is generally directed to a package for holding a plurality of articles. The package comprises panels that extend at least partially around an interior of the package. The panels comprise a top panel and a side panel foldably connected to the top panel. At least one opening in the top panel is for at least partially receiving at least a portion of one of the articles. A reinforcement flap is foldably connected to the top panel and positioned relative to the top panel for reinforcing the top panel.

In another aspect, the disclosure is generally directed to a blank for forming a package for holding a plurality of articles. The blank comprises panels that comprise a top panel and a side panel foldably connected to the top panel. At least one opening is in the top panel for at least partially receiving at least a portion of one of the articles. A reinforcement flap is foldably connected to the top panel and is for being positioned relative to the top panel for reinforcing the top panel.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

FIG. 1 is a plan view of an exterior side of a blank used to form a package according to a first embodiment of the disclosure.

Corresponding parts are designated by corresponding reference numbers throughout the drawings.

DETAILED DESCRIPTION OF THE EXEMPLARY EMBODIMENTS

Figure 2:
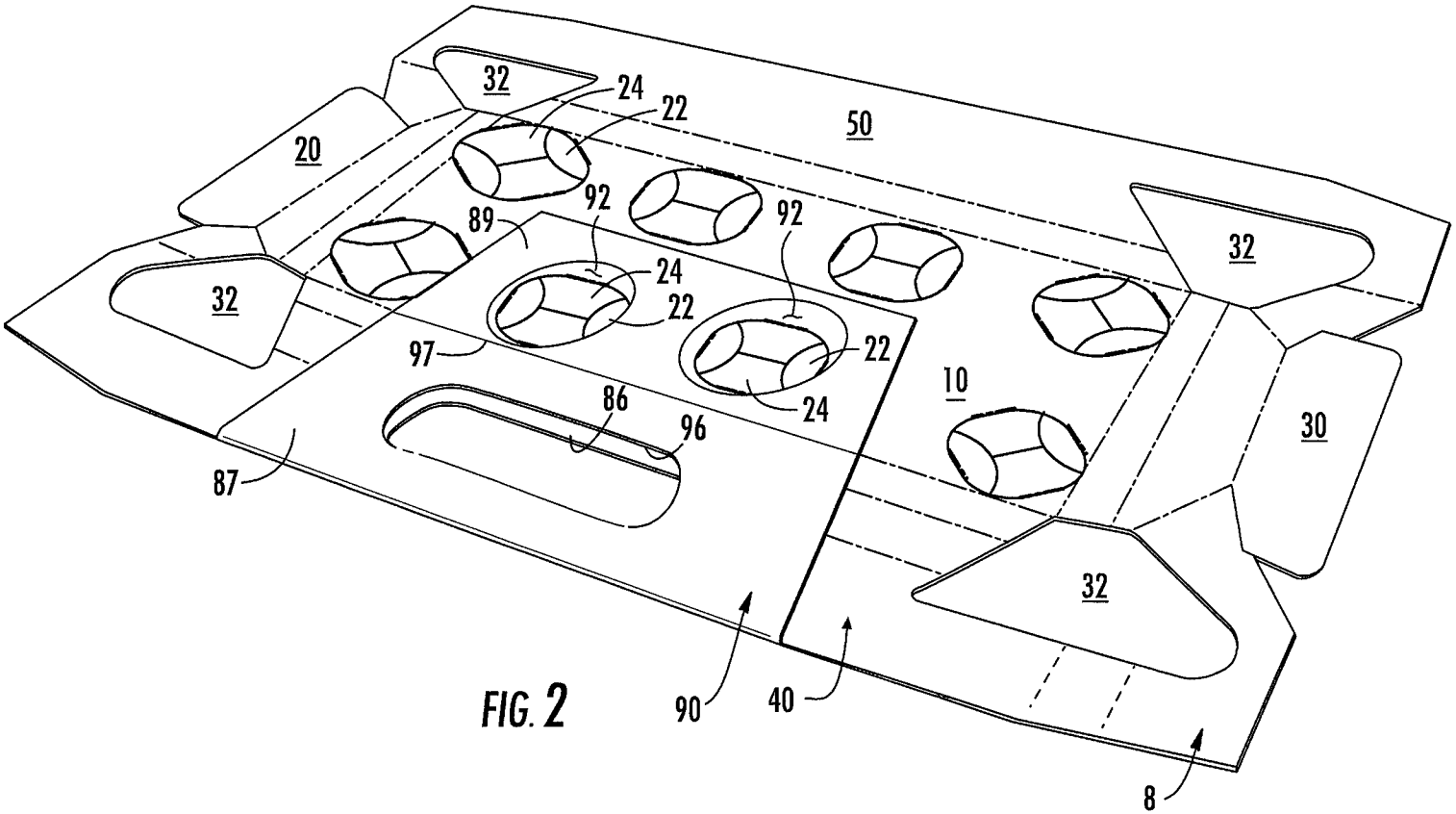
FIG. 2 is a view of an interior side of the blank of FIG. 1 partially erected into the package.

The present disclosure generally relates to constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, plastics such as PET, LDPE, LLDPE, HDPE, PP, PS, PVC, EVOH, and Nylon; and the like; aluminum and/or other metals; glass; or any combination thereof.

Packages according to the present disclosure can accommodate containers of numerous different shapes. For the purpose of illustration and not for the purpose of limiting the scope of the disclosure, the following detailed description describes beverage containers (e.g., plastic containers) at least partially disposed within the package embodiments. In this specification, the terms "lower," "bottom," "upper" and "top" indicate orientations determined in relation to fully erected packages.

The present embodiments are addressed to cartons or packages for attachment to and accommodation of containers. A package or carrier 150 is illustrated in its erected state in FIG. 5, in which it is attached to containers C arranged in two rows of four containers. In the illustrated embodiments the containers C are illustrated as beverage containers having a top portion generally comprising a flange portion F (FIG. 3), an upper neck portion N, and a cap CP, but containers of other sizes, shapes, and configurations, may be held in the package 150 without departing from the disclosure. The upper neck portions N of the containers C are received in respective openings 18 in the package 150 and retained in the package by retaining features described further herein. The containers could be arranged in other than a 2×4 arrangement (e.g., 2×3, 1×3, 1×4, etc.) without departing from the disclosure. In the illustrated embodiment, the package 150 includes a handle 7 (FIG. 5) for grasping and carrying the package. The handle 7 includes various features including reinforcement features as further described herein.

FIG. 1 is a plan view of an exterior side 3 of a blank 8 used to form the package or carrier 150. The blank 8 has a longitudinal axis L1 and a lateral axis L2. The blank 8 comprises a top panel 10 foldably connected to a first end panel 20 at a first lateral fold line 21 and foldably connected to a second end panel 30 at a second lateral fold line 31. A first side panel 40 is foldably connected to the top panel 10 at a first longitudinal fold line 41. A second side panel 50 is foldably connected to the top panel 10 at a second longitudinal fold line 51.

Figure 5:
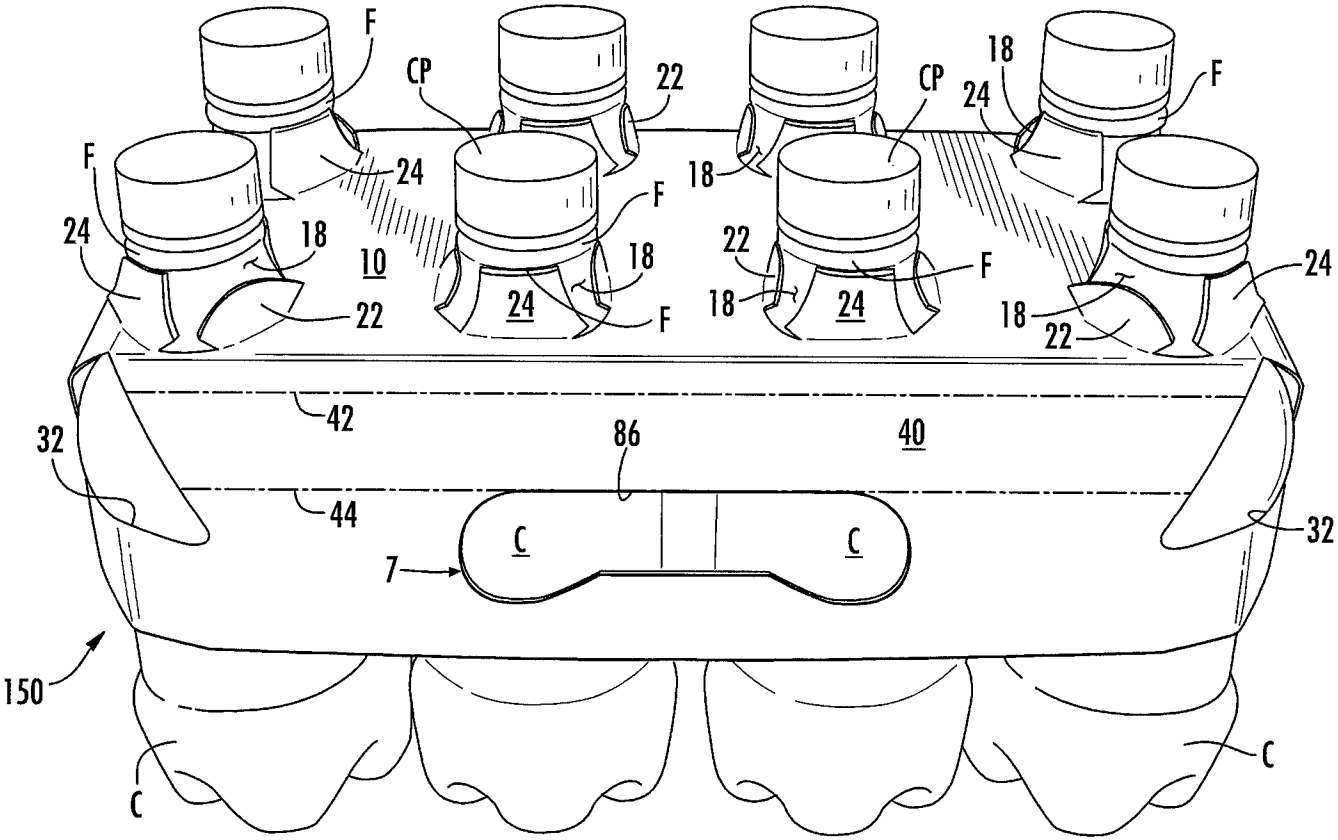
FIG. 5 is a side perspective of the package formed from the blank of FIG. 1.
Figure 6:
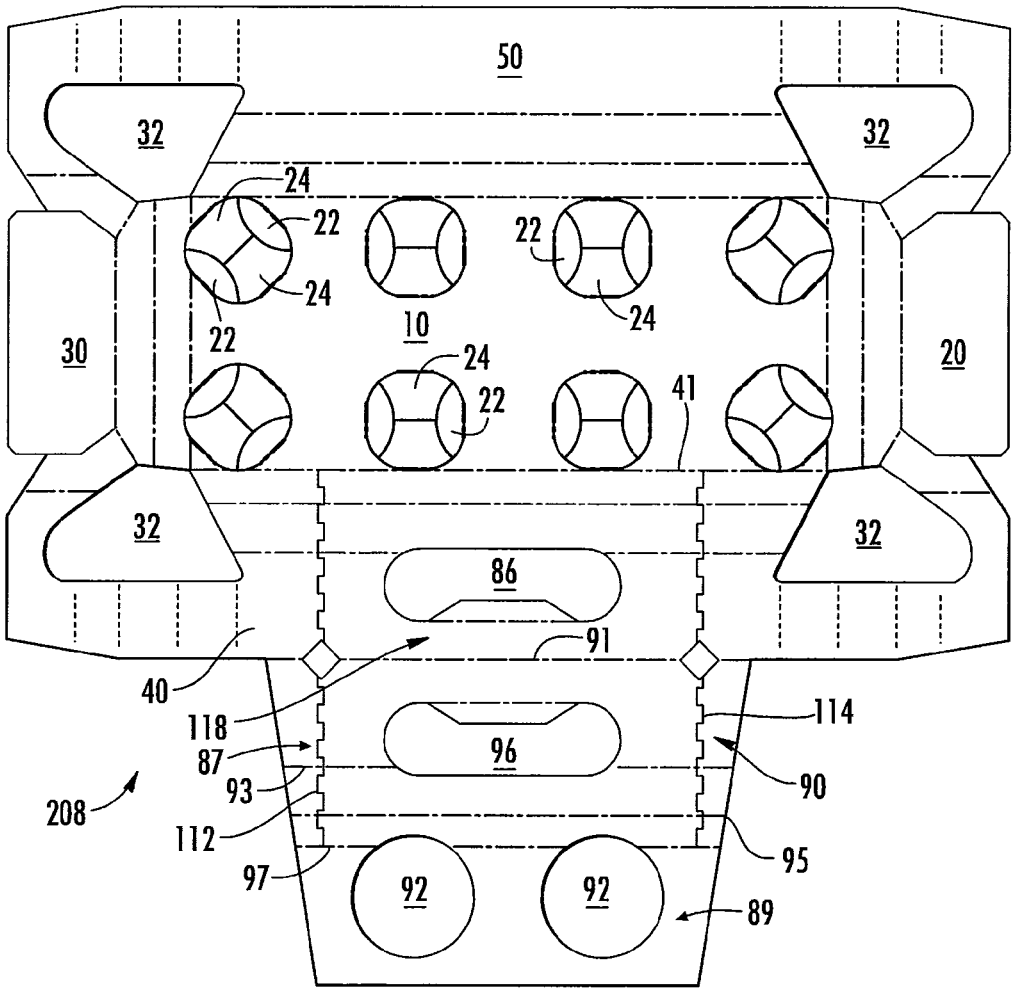
FIG. 6 is a plan view of an exterior side of a blank used to form a package according to a second embodiment.
Figure 7:
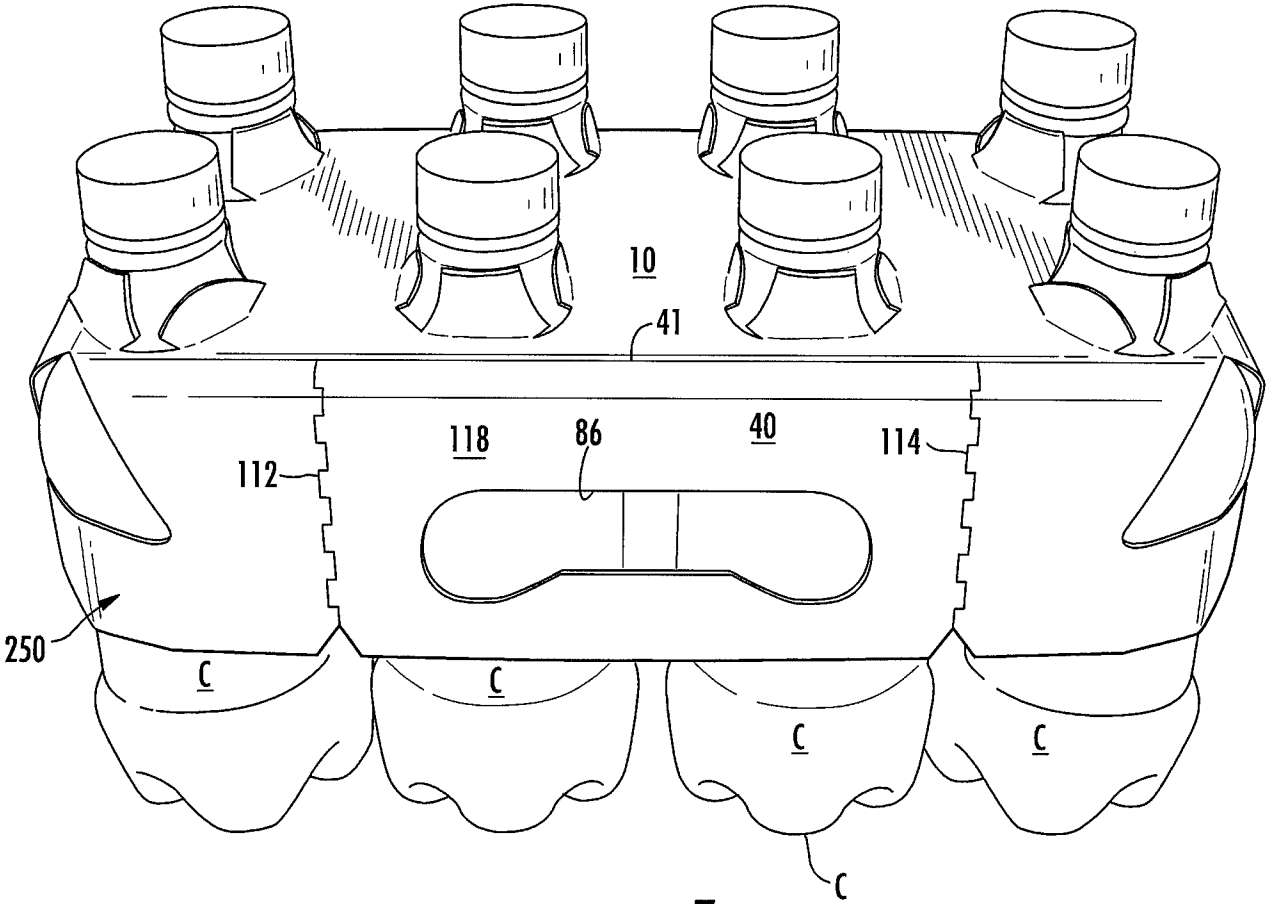
FIG. 7 is a side perspective of the package formed from the blank of FIG. 6.
Figure 8:
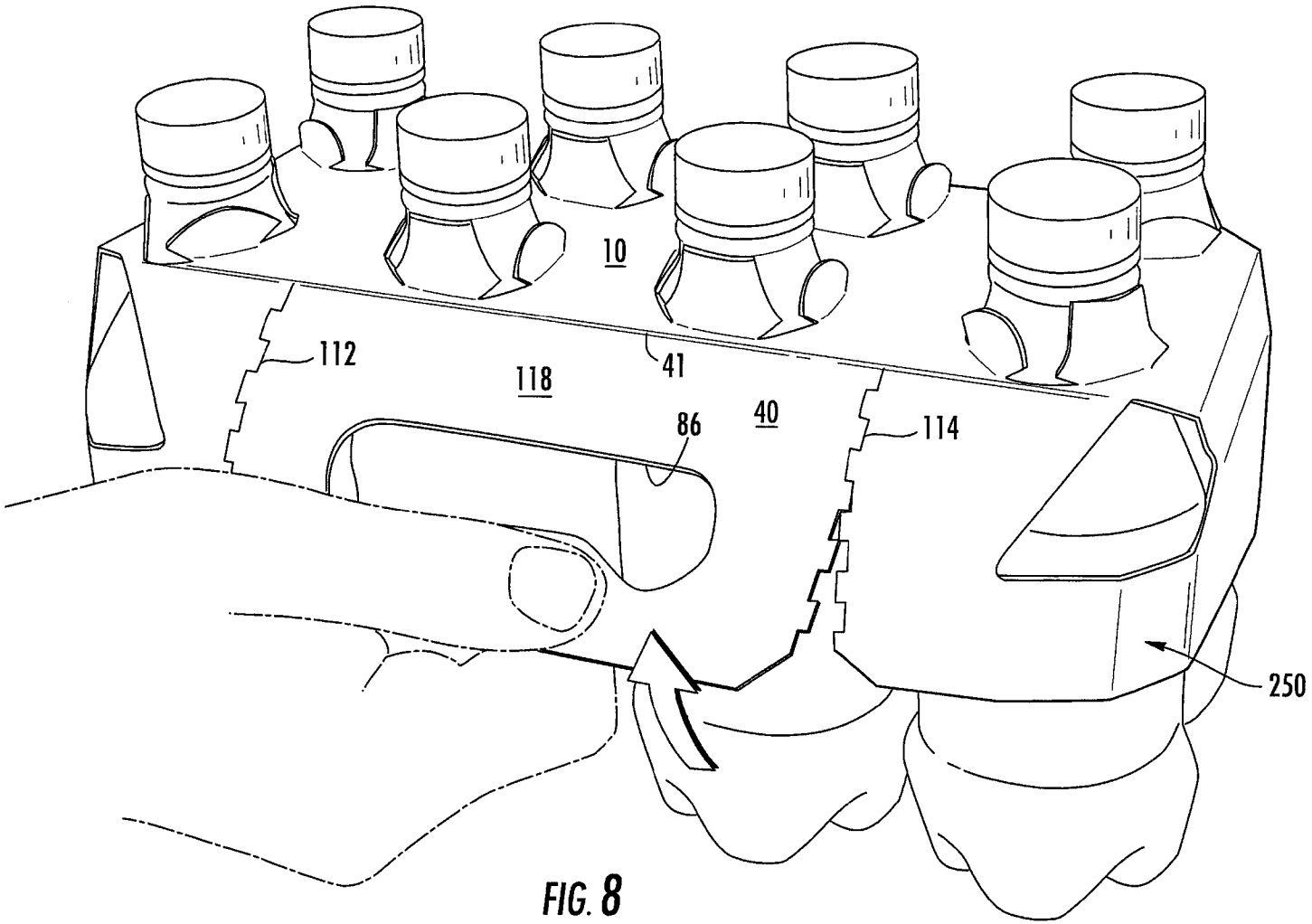
FIG. 8 is a view showing a handle of the package of FIG. 7 being raised.
Figure 9:
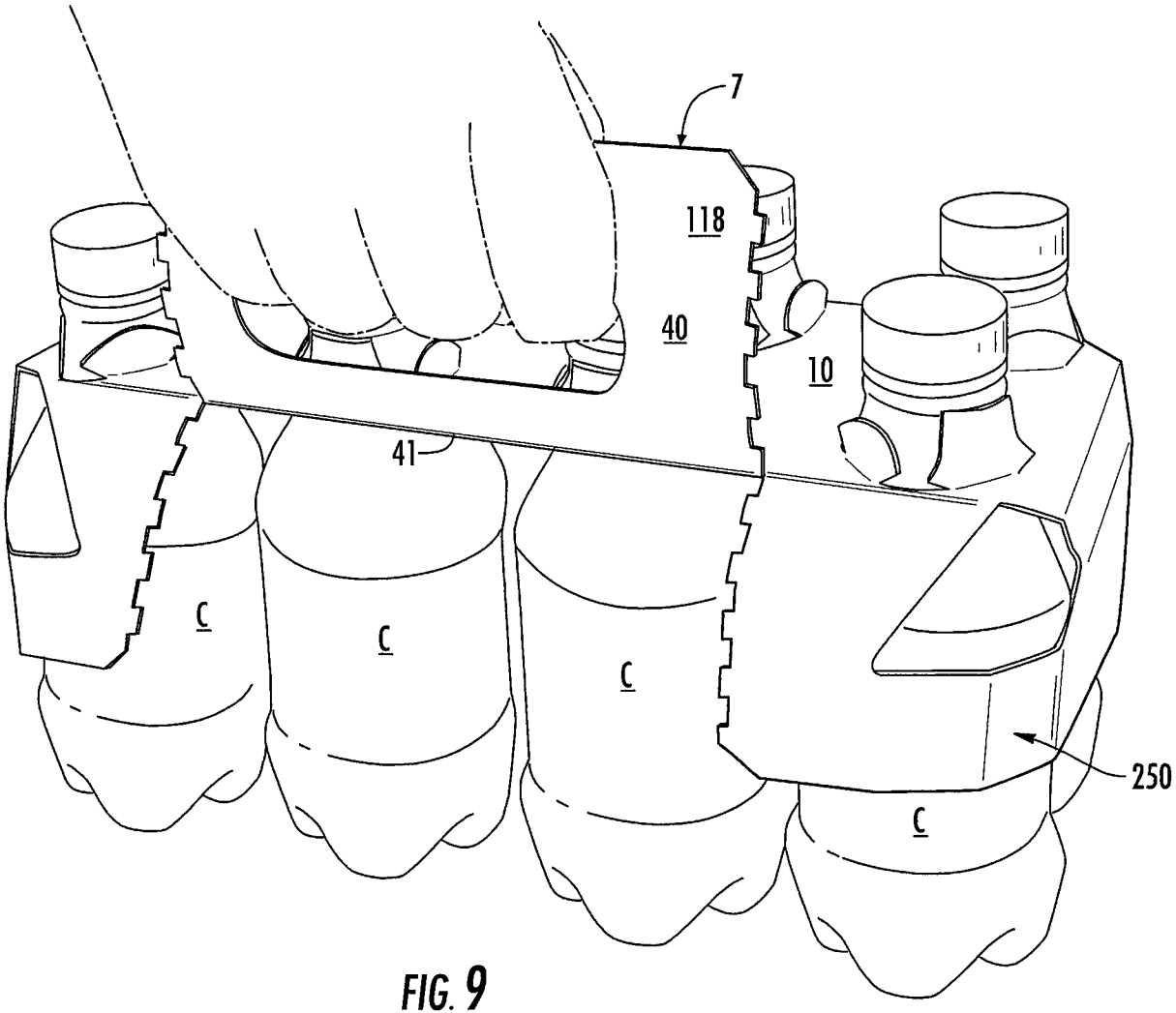
FIGS. 9 and 10 are views showing the handle of FIG. 8 raised and the package being carried at the handle.
Figure 10:
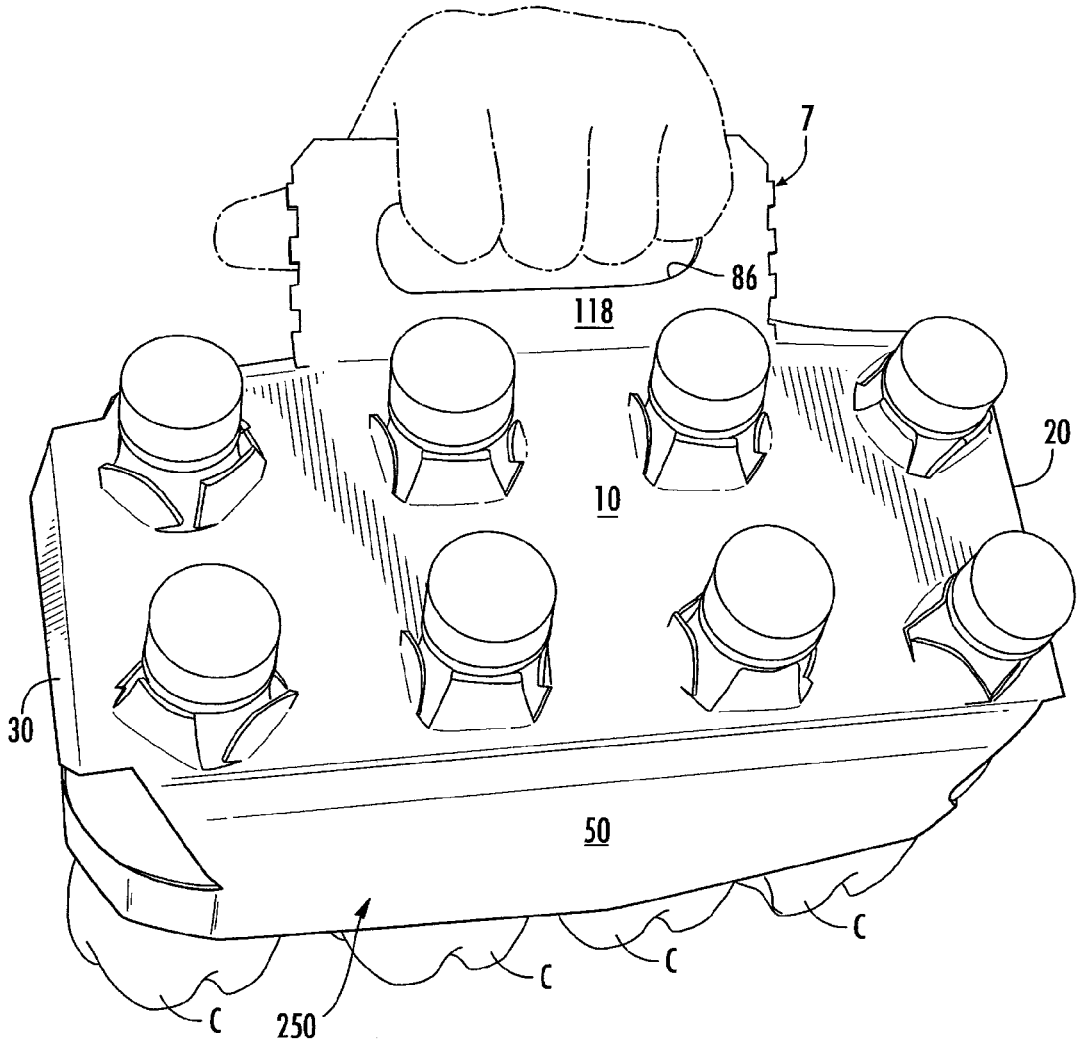

In the illustrated embodiment, the blank 8 includes eight receptacles 12 formed by tabs 22 and 24, which are connected to the top panel 10 by respective fold lines 37, 39. Slits 62 and 63 separate the tabs 22, 24 and arcuate slits 64 separate the tab fold lines 37, 39. The arcuate slits 64 and tab fold lines 37, 39 extend around and define a periphery of each of the openings 18 in the top panel 10. As shown in FIG. 5, the tabs 22, 24 surrounding each opening 18 are of different sizes so that when containers C are inserted into the openings 18 and the tabs 22, 24 are upwardly struck from the top panel 10, the shorter tabs 22 contact only the necks N of the containers and the longer tabs 24 contact both the necks and the underside of the flanges F to support the containers when the carrier is lifted. A variety of different configurations of tabs (e.g., tabs 22, 24) are within the scope of this disclosure.

The diameter of the openings 18 in the top panel 10 is related to the diameter of the neck portion N of the containers C to be packaged so that the containers are able to pass through the opening while contacting the support tabs 22, 24 of the receptacles 12 to pivot the support tabs up about their fold lines. In the illustrated embodiment, the support tabs 22 and 24 at the corner openings 18 are of somewhat different design than the support tabs 22 and 24 at the central openings. In both cases the support tabs 22, 24 take the form of four contiguous tabs arranged so that the fold lines 37, 39 of adjacent tabs are at right angles to each other. In both cases, one pair of oppositely located tabs 24 is longer than the other pair 22. In the illustrated embodiment, the tabs 22, 24, slits 62, 63, 64, and fold lines 37, 39 of the opening 18 at each of the two corners of the top panel 10 adjacent the second end panel 30 are respectively rotated clockwise and counterclockwise approximately 45 degrees from the orientation of the tabs, slits, and fold lines of the four central openings. The tabs 22, 24, slits 62, 63, 64, and fold lines 37, 39 of the opening 18 at each corner of the top panel 10 adjacent the first end panel 20 are respectively rotated counterclockwise and clockwise approximately 45 degrees from the orientation of the tabs, slits, and fold lines of the four central openings. The openings 18 in the top panel 10 can have other features including other tabs, slits, fold lines, tear lines, etc., and may be otherwise arranged and/or configured, without departing from the disclosure.

The blank 8 includes corner cutouts 32 in respective side panels that extend from the intersection of the lateral fold lines 21, 31 and longitudinal fold lines 41, 51. Longitudinal fold lines 42, 44 in the side panel 40 and longitudinal fold lines 52, 54 in side panel 50 extend between respective cutouts 32 in each side panel to form sloped side panel sections which generally conform to the slope of the containers C in the transition area between the neck N and the flange F of the containers. Additional fold lines 23, 25 in the end panel 20 and additional fold lines 33, 35 in the end panel 30 allow the end panels to conform closely to the contour of the containers C.

In one embodiment, the side panels 40, 50 are longer than the length of the top panel 10, terminating beyond the cutouts 32. Gusset panels 46 are connected to the side panels 40, 50 along longitudinal fold lines 48 and to the end panel panels 20, 30 along oblique fold lines 55. Slits 53 separate the gusset panels 46 from the end panels 20, 30. In the illustrated embodiment, the blank 8 includes groups of the parallel score lines 84 in the side panels 40, 50. The score lines 84 are parallel to the fold lines 21, 31 and extend generally from the cutouts 32 to the outer edge of the side flaps 20, 30. The score lines assist in forming the corners of the package 150 by wrapping the end panels around a respective container C at the corner of the package.

In the embodiment of FIG. 1, the handle features forming the handle 7 include a first handle opening 86 in the first side panel 40 and a reinforcement flap 90 foldably connected to the first side panel at a longitudinal fold line 91. In the illustrated embodiment, the reinforcement flap 90 includes a first portion 87 foldably connected to the first side panel 40 at the fold line 91 and a second, distal portion 89 foldably connected to the first portion at a longitudinal fold line 97. The first portion 87 includes two longitudinal fold lines 93, 95 and a second handle opening 96. The second portion 89 includes two generally circular apertures 92. In the illustrated embodiment, the handle 7 is in the first side panel 40, but in alternative embodiments, the handle could be in one or more of the second side panel 50, the end panels 20, 30, or top panel 10. Further, the terms "top", "side", and "end" indicate orientations determined in relation to the erected package 150 of the illustrated embodiment, and are not intended to limit the scope of the disclosure, as panels, flaps, or portions of the blank 8 could be otherwise orientated or positioned without departing from the disclosure.

To form the package 150 in accordance with one acceptable method, the reinforcement flap 90 is first folded along fold line 91 so that the first portion 87 of the reinforcement flap is in face-to-face contact with a portion of the inner surface of the side panel 40, and the second portion 89 of the reinforcement flap 90 is in face-to-face contact with side panel 40 and the top panel 10 (FIG. 2). As shown in the partially assembled configuration of FIG. 2, apertures 92 in the reinforcement flap 90 overlay and are axially aligned with the tabs 22, 24 and slits 62, 63, 64 of two of the central openings 18. Also, the second handle opening 96 in the reinforcement flap 90 overlies and is aligned with the first handle opening 86 in the side panel 40.

Figure 3:
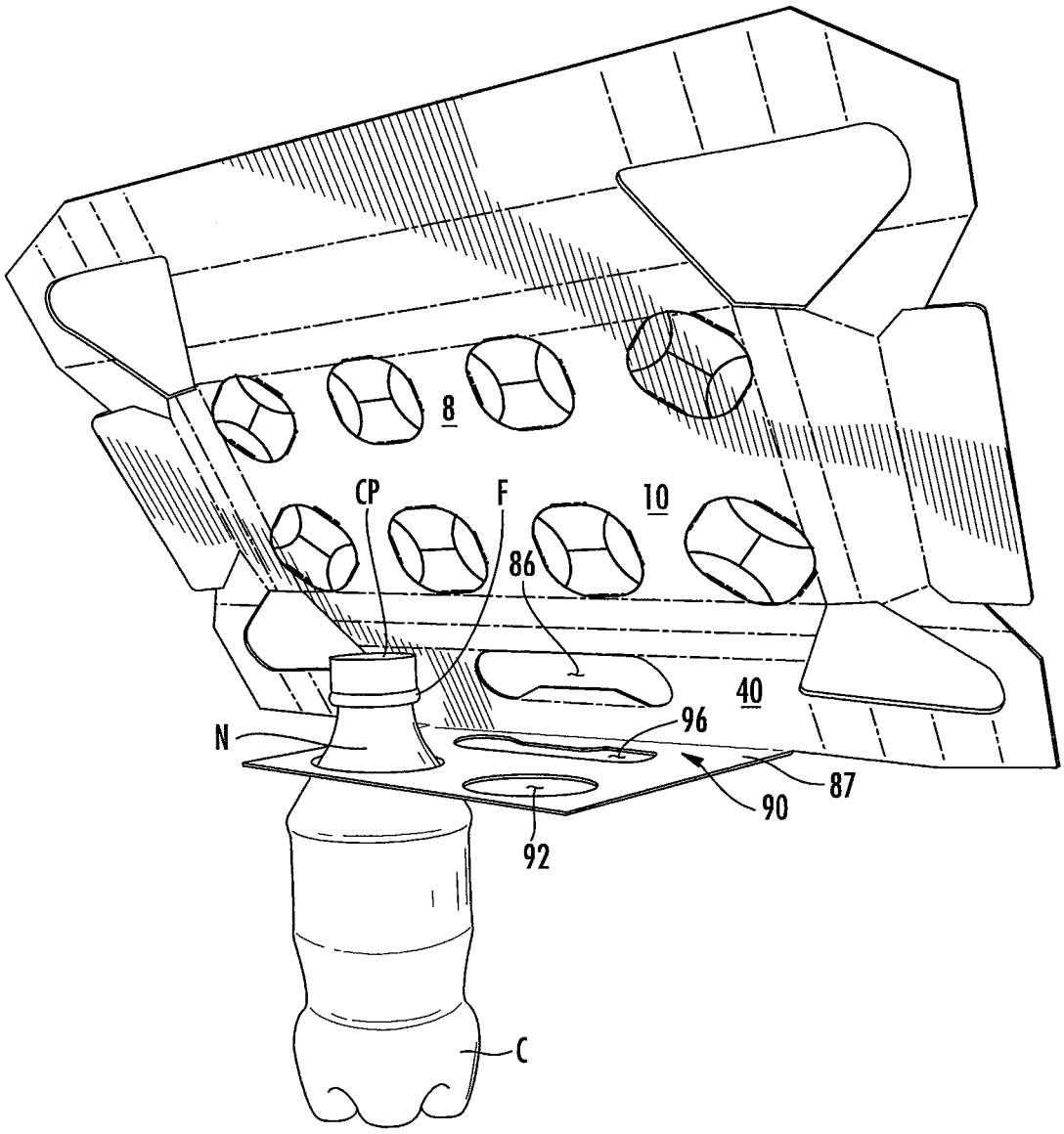
FIG. 3 is a view of the blank of FIG. 1 further partially erected.
Figure 4:
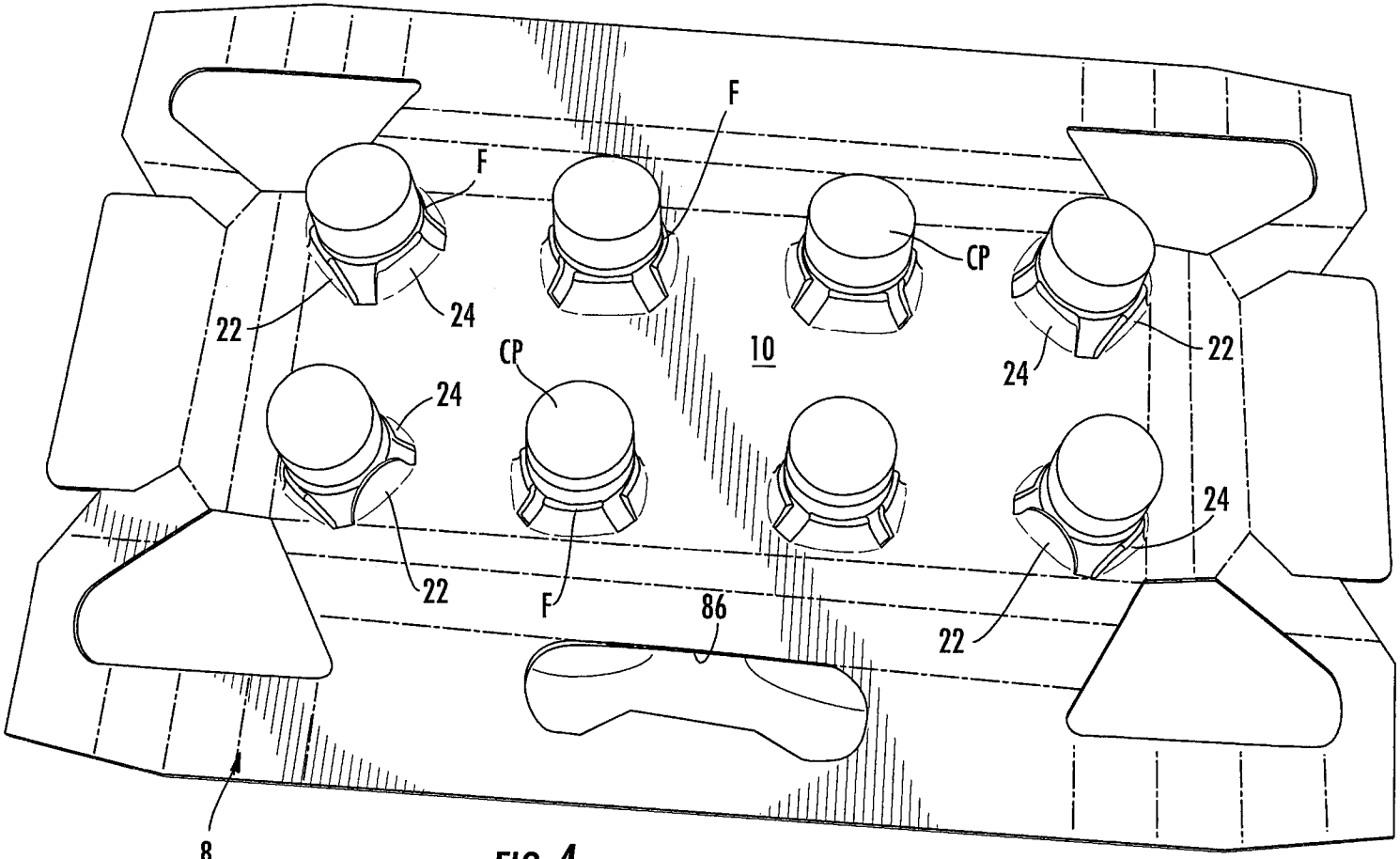
FIG. 4 is a top view of the blank of FIG. 1 further partially erected.

FIG. 3 illustrates a single container C being inserted into one of the apertures 92 for illustration purposes, the remaining containers C to be packaged together in the package 150 have been omitted. After the containers C to be packaged are grouped together and the reinforcement flap 90 is folded, the blank 8 is typically pushed down over the tops of the containers, or the containers can be moved relative to the blank. The caps CP of the containers C contact the support tabs 22, 24 to pivot the support tabs up relative to the top panel 10 to create the openings 18 in the top panel (FIG. 4). Also, two of the containers C move through the apertures 92 of the reinforcement flap 90 before passing through respective openings 18 in the top panel 10. Relative upward movement of the containers C continues until the support tabs 24 snap into place as the edges of these tabs engage the underside of the flanges F (FIG. 5). The shorter tabs 22 do not reach the flanges F but snugly engage the necks N. Next, the gusset panels 46 are folded down about fold lines 55 and up about fold lines 48, causing the gusset panels to contact the underside of the end panels 20, 30. It may be preferred during this step to pivot the end panels 20, 30 up about their fold lines 21, 31 which elevates the fold lines 55 and causes the side panels 40, 50 to automatically begin to fold down about the fold lines 41, 51, thereby facilitating the folding of the gusset panels 46. The end edges 70 of opposite side panels 40, 50 are moved toward each other during this folding sequence, causing the end portions of the side panels to curve around the adjacent corner containers until they are in their final position. The end panels 20, 30 are then folded down and glued to the underlying portions of the side panels 40, 50 to produce the final package 150 shown in FIG. 5.

The fold lines 84 facilitate the curving of the side panels 40, 50 about the corner containers C. Because the side panels 40, 50 follow the contour of the containers C instead of meeting in a folded corner arrangement spaced from the containers, the containers are snugly held in place. The optional cutouts 32 at the corners of the package 150 eliminate material which would tend to be compressed into unsightly irregular creases and folds when the side panels 40, 50 are folded into place, and minimize the size of the gusset panels 46. The cutouts 32 also provide biting edges which contact the containers C, further preventing the containers from moving. Although relatively large cutouts provide these beneficial results, including minimizing the length of the gusset fold lines 48 in order to reduce resistance against folding of the gusset panels 46, the gusset fold lines typically should remain of a length which provides enough force to pull the side panels 40, 50 into place upon folding of the gusset panels. The gusset panels 46 cause the side panels 40, 50 to move into place so as to snugly conform to the curvature of the corner containers C in the package 150 and maintain the end panels 20, 30 in that position prior to gluing the end panels to the end portions or extensions of the side panels 40, 50.

In the illustrated embodiment, the package 150 can be lifted by grasping the handle 7 at the overlapped handle openings 86, 96 in the side panel 40. The reinforcement flap 90 provides the package 150 with extra rigidity in a manner that seeks to prevent tearing or failure of the package when the package is lifted.

FIGS. 6-10 respectively show a blank 208 and a package 250 of a second embodiment of the disclosure having similar features as the blank 8 and package 150 of the first embodiment. Accordingly, similar or identical features of the embodiments are provided with like reference numbers. The handle 7 of the package 250 is foldably connected to the top panel 10 along fold line 41. The blank 208 of the second embodiment includes two lateral tear lines 112, 114 extending from (e.g., substantially from) the fold line 41 to the fold line 97 in the reinforcement flap 90.

In the illustrated embodiment, the tear lines 112, 114 extend across the side panel 40 and across the first portion 87 of the reinforcement flap 90. As shown in FIGS. 7-10, the tear lines 112, 114 define a handle panel 118 of the handle 7 when the first portion 87 of the reinforcement flap 90 is in face-to-face contact with the side panel 40. The handle panel 118 can be raised by tearing along the tear lines 112, 114 and lifting the handle panel upward about fold line 41. The package 250 may be lifted and carried by the handle 7 by grasping the handle panel 118 at overlapped openings 86, 96. The handle 7 could be otherwise shaped, arranged, or configured without departing from the scope of this disclosure.

Figure 11:
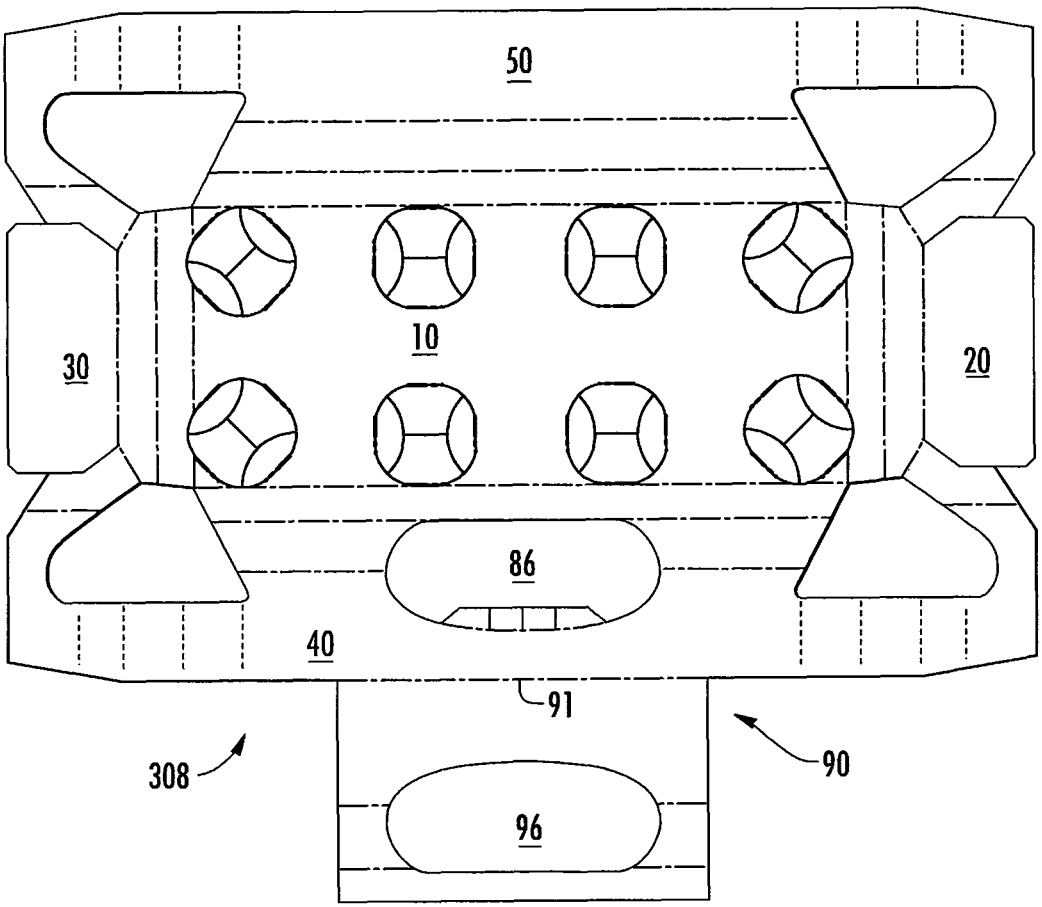
FIG. 11 is a plan view of an exterior side of a blank used to form a package according to a third embodiment.
Figure 12:
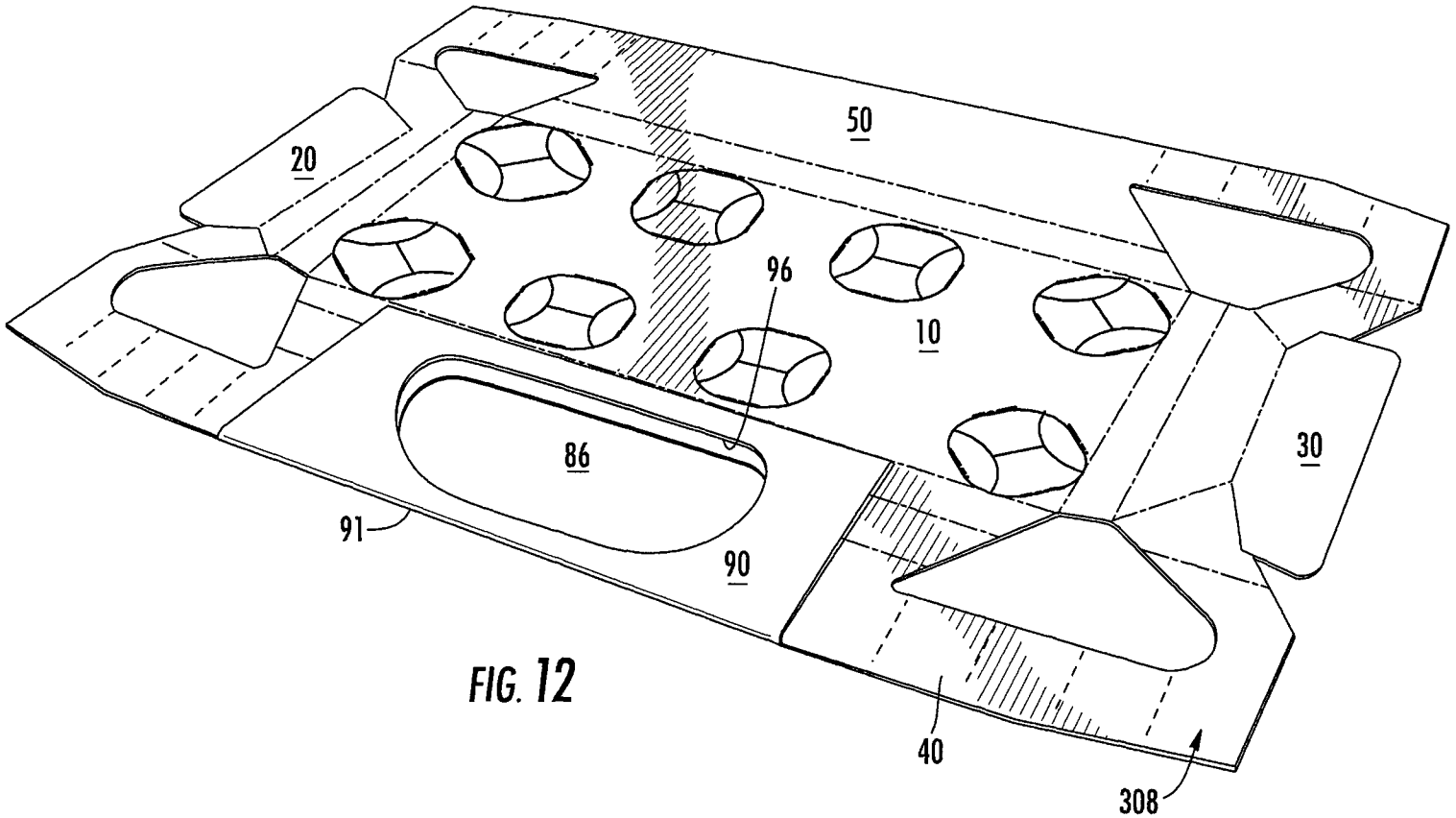
FIG. 12 is a view of an interior side of the blank of FIG. 11 partially erected into the package.

FIGS. 11-12 show a blank 308 for forming a package (not shown) of a third embodiment of the disclosure having similar features as the blank and packages of the previous embodiments. The blank 308 includes a reinforcement flap 90 that is smaller than the reinforcement flap of the first and second embodiments. As shown in FIG. 12, the reinforcement flap 90 of the blank 308 is folded about fold line 91 to be in face-to-face contact with the side panel 40 when the blank is formed into the package. The reinforcement flap 90 of the third embodiment does not overlap a portion of the top panel 10 when the blank 308 is assembled into the package.

Figure 13:
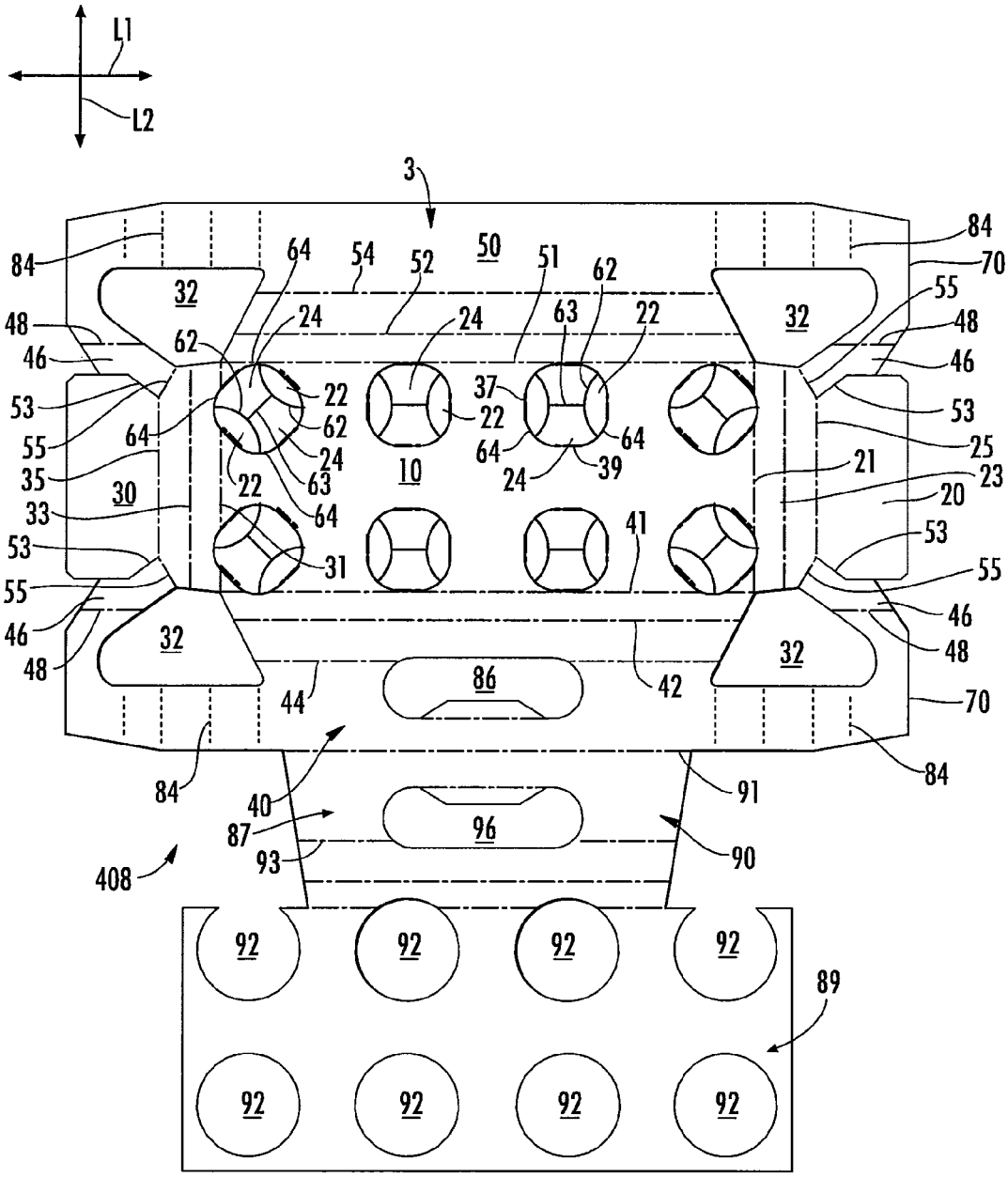
FIG. 13 is a plan view of an exterior side of a blank used to form a package according to a fourth embodiment.

FIG. 13 shows a blank 408 for forming a package (not shown) of a fourth embodiment of the disclosure having similar features as the blank and packages of the previous embodiments. Accordingly, similar or identical features of the embodiments are provided with like reference numbers. The blank 408 includes a reinforcement flap 90 that is larger than the reinforcement flap of the previous embodiments. As shown in FIG. 13, the reinforcement flap 90 of the blank 408 includes a first portion 87 similar to the first embodiment and a second portion 89 larger than the second portion of the reinforcement flap of the first embodiment. In the embodiment of FIG. 13, the second portion 89 is sized to cover substantially all of the top panel 10 when the reinforcement flap 90 is positioned in face-to-face contact with the top panel. The second portion 89 includes eight openings 92 to correspond with (e.g., being respectively coaxially aligned with and adjacent to) each of the eight openings 18 in the top panel.

Figure 14:
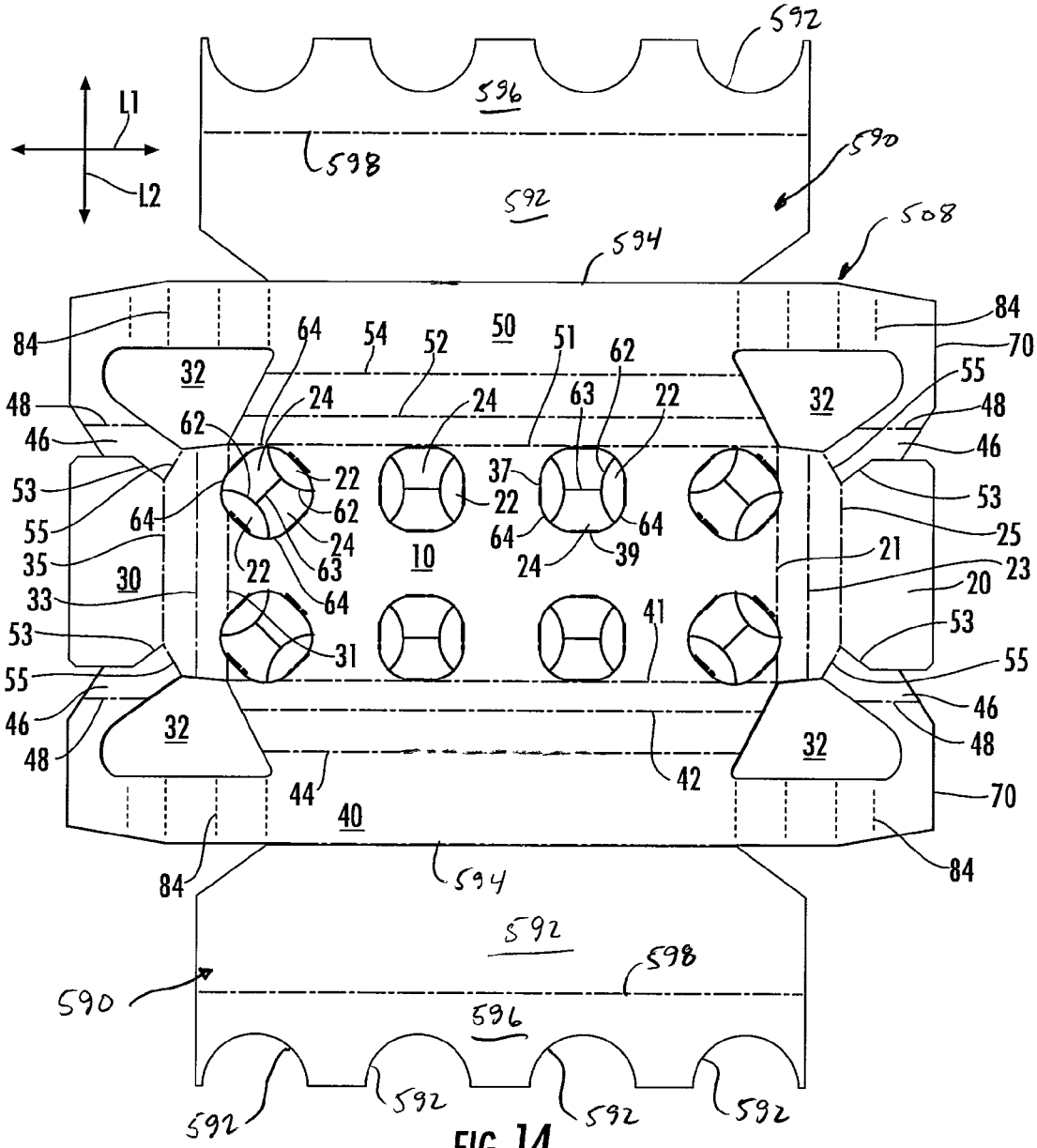
FIG. 14 is a plan view of an exterior side of a blank used to form a package according to a fifth embodiment.
Figure 15:
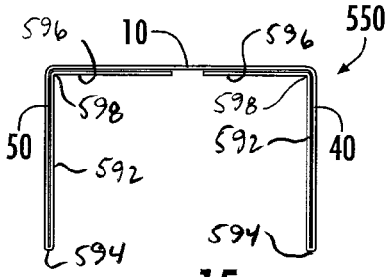
FIG. 15 is a schematic end view of the package of the fifth embodiment.

FIGS. 14 and 15 illustrate a blank 508 for forming a package 550 (FIG. 15) of a fifth embodiment of the disclosure having similar features as the blanks and packages of the previous embodiments. Accordingly, similar or identical features of the embodiments are provided with like reference numbers. The blank 508 includes two reinforcement flaps 590, each reinforcement flap is foldably connected to a respective side panel 40, 50. Each reinforcement flap 590 comprises a first portion 592 respectively foldably connected to one of the side panels 40, 50 at a respective fold line 594. Each reinforcement flap 590 comprises a second portion 596 foldably connected to a respective first portion 592 at a fold line 598. Each second portion 596 of the reinforcement flaps 590 has notches 593 at an outer edge 599 of a respective flap. The notches 92 cooperate with the respective opening 18 in the top panel 10 to form receptacles 12 for receiving and holding containers C (FIG. 5). As shown in FIG. 15, the first portion 592 of each reinforcement flap 590 is placed in face-to-face contact with an inner surface of a respective side panel 40, 50 of the package 550. A second portion 596 of each reinforcement flap 590 is placed in face-to-face contact with an inner surface of the top panel 10. The blank 508 and package 550 could be otherwise shaped, arranged, and configured without departing from the disclosure.

Figure 16:
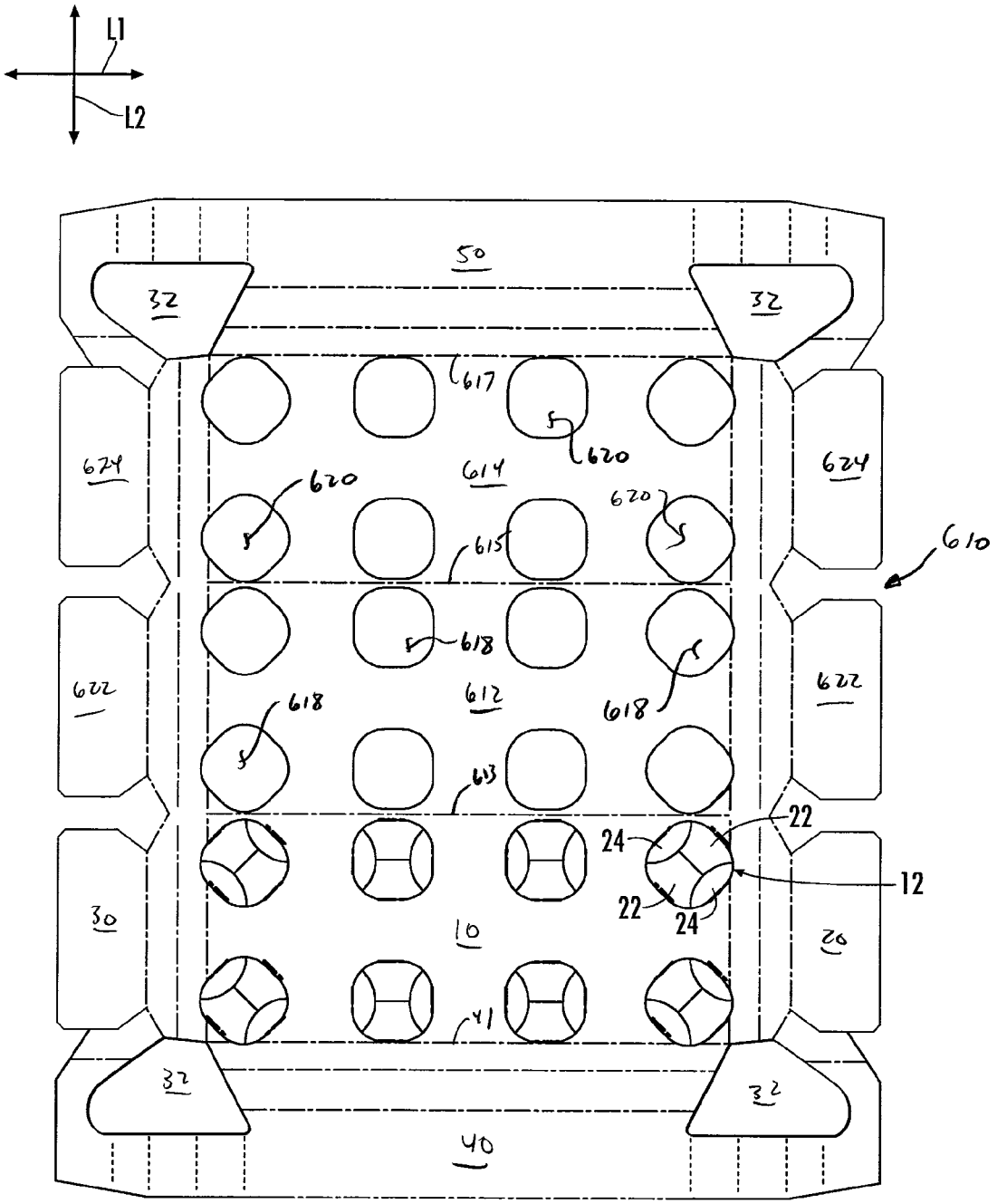
FIG. 16 is a plan view of an exterior side of a blank used to form a package according to a sixth embodiment.
Figure 17:
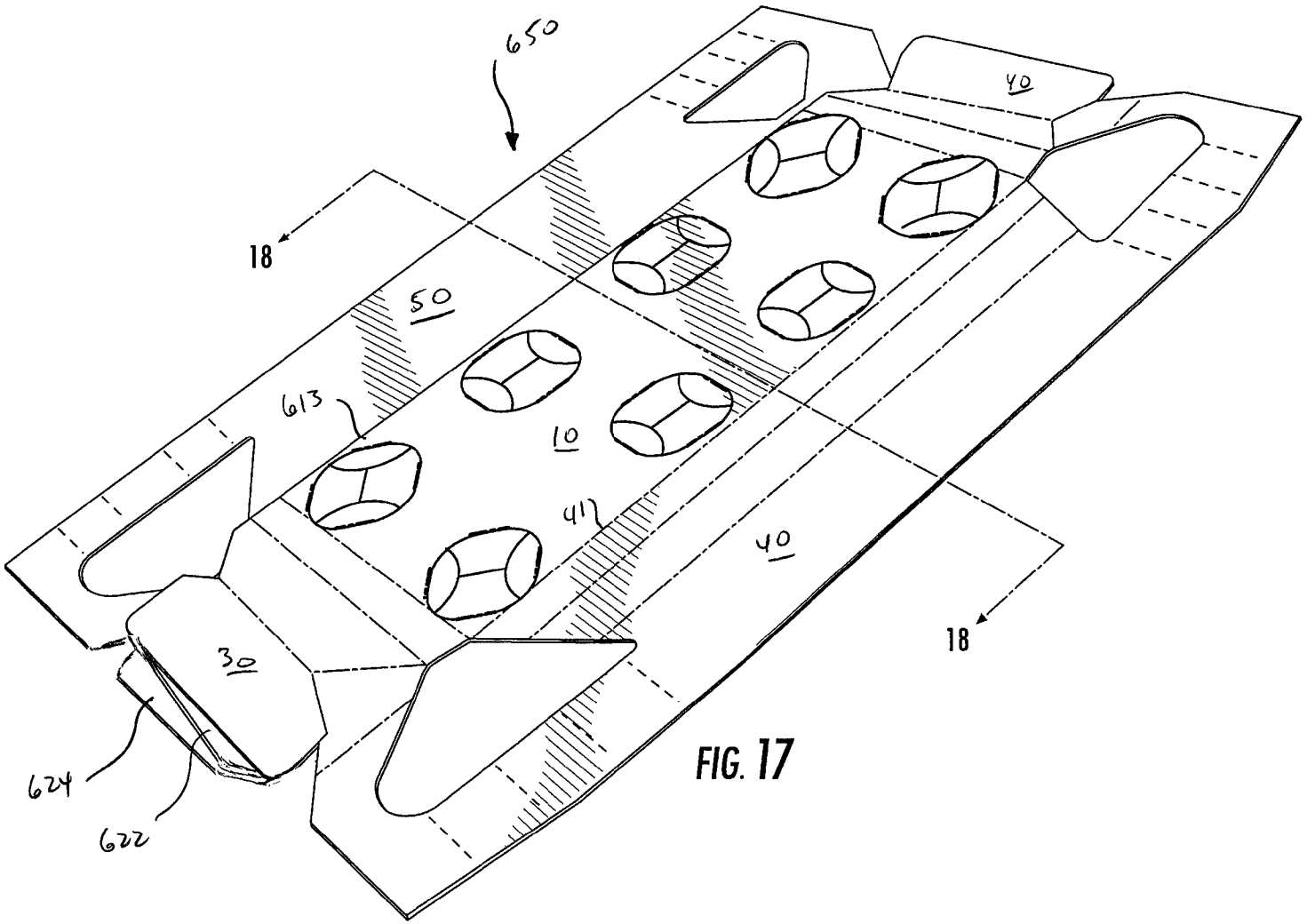
FIG. 17 is a perspective view of the partially assembled blank of FIG. 16.
Figure 18:
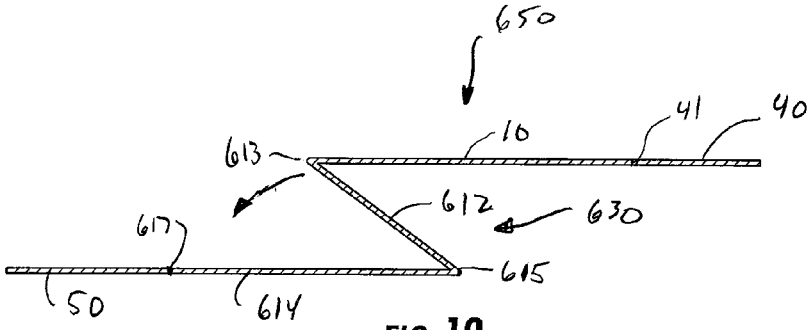
FIG. 18 is a schematic end view of the blank of the sixth embodiment partially assembled into the package.

FIGS. 16-18 illustrate a blank 608 for forming a package 650 of a sixth embodiment of the disclosure having similar features as the blanks and packages of the previous embodiments. Accordingly, similar or identical features of the embodiments are provided with like reference numbers. In the sixth embodiment, the blank 606 includes a reinforcement flap 610 foldably connected to the top panel 10 at a fold line 613. The reinforcement flap 610 comprises a first portion 612 foldably connected to the top panel 10, and a second portion 614 foldably connected to the first portion at a fold line 615 and foldably connected to the second side panel 50 at a fold line 617. The first portion 612 has openings 618 and the second portion 614 has openings 620. In one embodiment, each of the first portion 612 and the second portion 614 has respective end flaps 622, 624. The reinforcement flap 610 could be otherwise shaped, arranged, and/or configured.

In the embodiment of FIGS. 16-18, the blank 608 is assembled into the package 650 by positioning the fold line 613 connecting the first portion 612 of the reinforcement flap 610 to the top panel 10 to generally overlap the fold line 617. The bottom surface of the first portion 612 and the top surface of the second portion 614 of the reinforcement flap 610 are placed in face-to-face contact. In the illustrated embodiment, the bottom surface of the top panel 10 is placed in face-to-face contact with the top surface of the first portion 612 of the reinforcement flap 610. As shown in FIG. 17, the package 650 is formed by folding the blank 608 in a manner that creates a reinforced central panel 630 that comprises three layers of material (e.g., the top panel 10, the first portion 612 of the reinforcement flap 610, and the second portion 614 of the reinforcement flap). Openings 18 in the top of the package 650 extend through top panel 10 and are aligned with respective openings 618, 620 of the first portion 612 and second portion 614 of the reinforcement flap 610. One or both of the first and second portions 612, 614 of the reinforcement flap 610 can be adhesively connected to the top panel 10 (e.g., by glue). The blank 608 and package 650 can be otherwise shaped, arranged, and configured without departing from the disclosure.

Figure 19:
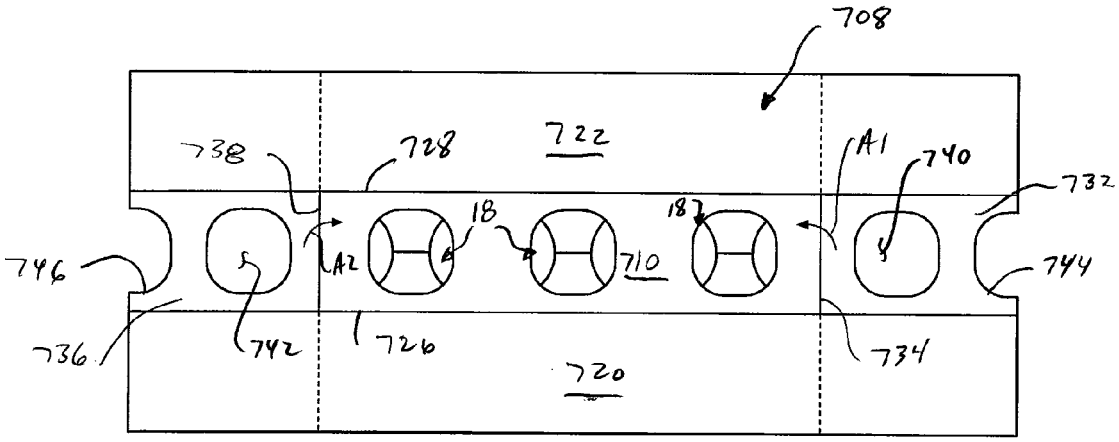
FIG. 19 is a plan view of an exterior side of a blank used to form a package according to a seventh embodiment.
Figure 20:
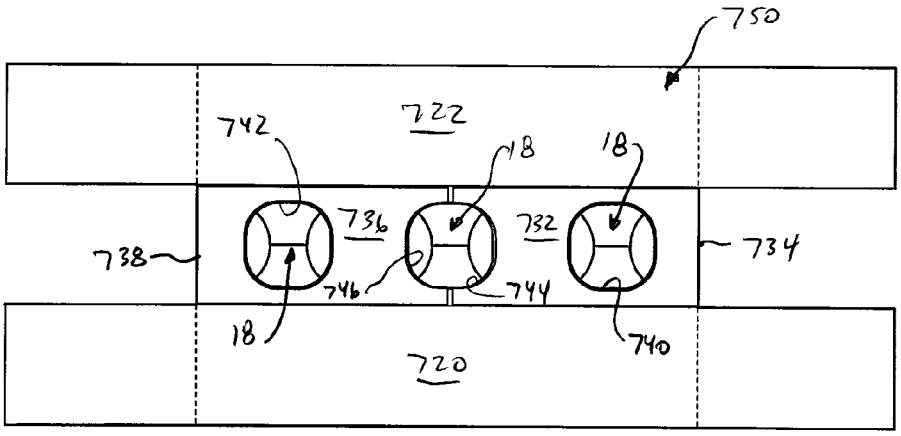
FIG. 20 is a plan view of the blank of FIG. 19 partially assembled into the package.

FIGS. 19 and 20 illustrate a blank 708 for forming a package 750 of a seventh embodiment of the disclosure having similar features as the blanks and packages of the previous embodiments. Accordingly, similar or identical features of the embodiments are provided with like reference numbers. In the seventh embodiment, the top panel 710 includes a single row of openings 718 that are similar to the openings 18 of the previous embodiments and are for receiving a single row of containers (not shown). The blank 708 and package 750 could accommodate more than one row of containers without departing from this disclosure. As shown in FIGS. 19 and 20, the top panel 710 has three openings 718, but the top panel could have more or less than three openings without departing from the disclosure.

The blank 708 has a first side panel 720 and a second side panel 722 respectively foldably connected to the top panel 710 at respective fold lines 726, 728. A first reinforcement flap 732 is foldably connected to a first end of the top panel 710 at a fold line 734 and a second reinforcement flap 736 is foldably connected to a second end of the top panel at a fold line 738. The reinforcement flaps have respective openings 740, 742 and notches 744, 746.

As shown in FIGS. 19 and 20, the reinforcement flaps 732, 736 can be folded about arrows A1, A2 so that the reinforcement flaps are in face to face contact with the top panel 710. In the illustrated embodiment, the openings 740, 742 overlay a respective end opening 18 of the top panel 710 and the notches 744, 746 cooperate to frame the central opening of the top panel. The blank 708 can be further formed into the package 750 by inserting containers C through the openings 18 and downwardly folding the side panels 720, 722 relative to the top panel 710. In the illustrated embodiment, the reinforcement flaps 732, 736 are in face-to-face contact with the bottom surface of the top panel 710, but the reinforcement flaps could be alternatively positioned to be in face-to-face contact with the top surface of the top panel. The blank 708 and package 750 can be otherwise shaped, arranged, and configured without departing from the disclosure.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the claims. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding a plurality of articles, the package comprising:

panels that extend at least partially around an interior of the package, the panels comprise a top panel and a side panel foldably connected to the top panel, the side panel being foldably connected to the top panel at a fold line and extending downwardly from the top panel to conform to the contour of the articles;

at least one opening in the top panel for at least partially receiving at least a portion of one of the articles;

a reinforcement flap comprising a first portion in face-to-face contact with the side panel and a second portion in face-to-face contact with the top panel, the first portion being foldably connected to the side panel and the second portion and positioned relative to the side panel for reinforcing the side panel, the first portion is foldably connected to the side panel at a first fold line and the first portion is foldably connected to the second portion at a second fold line, the first fold line is located directly between the side panel and the first portion of the reinforcement flap and forms the lower edge of the side panel that at least partially defines the interior of the package, wherein the side panel is a first side panel and the reinforcement flap is a first reinforcement flap foldably connected to the first side panel, the package further comprises a second side panel foldably connected to the top panel and a second reinforcement flap foldably connected to the second side panel.

2. The package of claim 1 wherein the panels comprise an end panel foldably connected to the top panel, and the end panel is foldably connected to the side panel.

3. The package of claim 2 wherein the package comprises a gusset panel foldably connected to the end panel and foldably connected to the side panel.

4. The package of claim 1 in combination with the articles, the articles comprising beverage containers having an upper portion and a flange, wherein the at least one opening comprises a plurality of openings, each of the openings comprises a periphery and the top panel comprises four tabs foldably connected to the top panel at the periphery of each of the openings.

5. The package of claim 4 wherein the four tabs at each opening comprise two shorter tabs that contact the upper portion of one of the containers and two longer tabs that contact an underside of the flange of the one of the containers to retain the containers in the package.

6. The package of claim 1 wherein the second portion of the reinforcement flap comprises at least two openings, the at least one opening in the top panel comprises at least two openings, the openings in the reinforcement flap being respectively aligned with the openings in the top panel.

7. The package of claim 1 wherein the second portion of the reinforcement flap comprises at least two openings, the at least one opening in the top panel comprises at least two openings, the openings in the reinforcement flap being respectively aligned with the openings in the top panel, and the at least two openings in the reinforcement flap comprises notches in a peripheral edge of the reinforcement flap.

8. A blank for forming a package for holding a plurality of articles, the blank comprising:

panels that comprise a top panel and a side panel foldably connected to the top panel, the side panel being foldably connected to the top panel at a fold line and being for extending downwardly from the top panel to conform the contour of the articles in the package formed from the blank;

at least one opening in the top panel;

a reinforcement flap comprising a first portion for being in face-to-face contact with the side panel and a second portion for being in face-to-face contact with the top panel, the first portion being foldably connected to the side panel and the second portion for positioning relative to the side panel and reinforcing the side panel, the first portion is foldably connected to the side panel at a first fold line and the first portion is foldably connected to the second portion at a second fold line, the first fold line is located directly between the side panel and the first portion of the reinforcement flap and forms the lower edge of the side panel that at least partially defines the interior of the package formed from the blank; and wherein the side panel is a first side panel and the reinforcement flap is a first reinforcement flap foldably connected to the first side panel, the blank further comprises a second side panel foldably connected to the top panel and a second reinforcement flap foldably connected to the second side panel.

9. The blank of claim 8 further comprising an end panel foldably connected to the top panel, and a gusset panel foldably connected to the end panel and the side panel.

10. The blank of claim 8 wherein the second portion of the reinforcement flap comprises at least two openings, the at least one opening in the top panel comprises at least two openings, the openings in the reinforcement flap being aligned with respective openings in the top panel.

11. The blank of claim 8 wherein the second portion of the reinforcement flap comprises at least two openings, the at least one opening in the top panel comprises at least two openings, the openings in the reinforcement flap are for being aligned with respective openings in the top panel in the package formed from the blank, the at least two openings in the reinforcement flap comprises notches in a peripheral edge of the reinforcement flap.

12. The blank of claim 8 wherein the at least one opening comprises a plurality of openings, each of the openings comprises a periphery and the top panel comprises four tabs foldably connected to the top panel at the periphery of each of the openings.

13. The blank of claim 12 wherein the four tabs at each opening comprise two shorter tabs and two longer tabs to retain a respective article of the plurality of the articles in the package formed from the blank.

14. A method of forming a package, the method comprising:

obtaining a blank comprising a top panel, a side panel foldably connected to the top panel, the side panel being foldably connected to the top panel at a fold line, a plurality of openings in the top panel, and a reinforcement flap comprising a first portion and a second portion, the first portion being foldably connected to the side panel and the second portion for positioning relative to the side panel and reinforcing the side panel, the first portion is foldably connected to the side panel at a first fold line and the first portion is foldably connected to the second portion at a second fold line, wherein the first fold line is located directly between the side panel and the first portion of the reinforcement flap, wherein the side panel is a first side panel and the reinforcement flap is a first reinforcement flap foldably connected to the first side panel, the blank further comprises a second side panel foldably connected to the top panel and a second reinforcement flap foldably connected to the second side panel;

positioning a plurality of articles relative to the blank;

positioning the blank relative to the articles so that the plurality of articles is at least partially received in respective openings of the plurality of openings;

folding the first reinforcement flap at the first fold line so that the first portion is in face-to-face contact with the side panel and placing the second portion in face-to-face contact with the top panel;

downwardly folding the side panel relative to the top panel to at least partially enclose the articles in an interior space of the package, conform the side panel to the contour of the articles, and form the lower edge of the side panel at the first fold line.

15. The method of claim 14 wherein the plurality of articles comprises beverage containers having an upper portion and a flange, wherein each of the openings comprises a periphery and the top panel comprises four tabs foldably connected to the top panel at the periphery of each of the openings, the method comprising attaching the containers to the blank by inserting at least a portion of the containers into respective openings so that at least two of the tabs contact an underside of a flange of a respective container.

16. The method of claim 15 wherein the second portion of the reinforcement flap comprises at least two openings, the method further comprising positioning the reinforcement flap so that at least two of the plurality of articles are received in the respective openings in the reinforcement flap.

17. The method of claim 15 wherein the method further comprises folding the second reinforcement flap and placing a first portion of the second reinforcement flap in face-to-face contact with the second side panel and placing a second portion of the second reinforcement flap in face-to-face contact with the top panel.

18. The package of claim 1 wherein the first portion has a first width between the first fold line and the second fold line, the first width being substantially equal to a width of the side panel.

19. The package of claim 1 wherein the reinforcement flap has a free edge and the second portion has a second width from the second fold line to the free edge.

* * * * *